US006305077B1

(12) United States Patent
Conner et al.

(10) Patent No.: US 6,305,077 B1
(45) **Date of Patent: *Oct. 23, 2001**

(54) REPAIR OF COATED TURBINE COMPONENTS

(75) Inventors: Jeffrey A. Conner, Hamilton; Michael J. Weimer, Loveland, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/443,118

(22) Filed: Nov. 18, 1999

(51) Int. Cl.[7] ..... B23P 6/00
(52) U.S. Cl. ..... 29/889.1; 29/889.7; 427/142
(58) Field of Search ..... 29/889.1, 889.725, 29/889.7, 889.72, 402; 134/4, 1; 427/142

(56) References Cited

U.S. PATENT DOCUMENTS

| | | | | |
|---|---|---|---|---|
| 4,501,776 | | 2/1985 | Shankar | 427/253 |
| 4,619,707 | * | 10/1986 | Hershmeier et al. | 134/3 |
| 5,139,824 | | 8/1992 | Liburdi et al. | 427/252 |
| 5,210,944 | * | 5/1993 | Monson et al. | 29/889.1 |
| 5,494,704 | | 2/1996 | Ackerman | 427/237 |
| 5,558,922 | * | 9/1996 | Gupta et al. | 29/889.1 |
| 5,679,270 | * | 10/1997 | Thornton et al. | 216/101 |
| 5,723,078 | | 3/1998 | Nagarej et al. | 264/36 |
| 5,813,118 | * | 9/1998 | Roedl et al. | 29/889.1 |
| 5,897,966 | | 4/1999 | Crossklaus, Jr. et al. | 428/652 |
| 5,898,994 | * | 5/1999 | Miller et al. | 29/889.1 |
| 5,972,424 | * | 10/1999 | Draghi et al. | 427/142 |
| 6,042,879 | * | 3/2000 | Draghi et al. | 427/142 |
| 6,042,880 | * | 3/2000 | Rigney et al. | 427/142 |
| 6,146,692 | * | 11/2000 | Sangeeta et al. | 427/142 |

FOREIGN PATENT DOCUMENTS 55-082760A 6/1980 (JP) .

OTHER PUBLICATIONS

ASM International Handbook Committee, "ASM Handbook, Formerly Ninth Edition, Metals Handbook, vol. 13: Corrowion", pp. 420–431, Dec. 1992.
U.S. patent application Ser. No. 09/438,511 filed Nov. 12, 1999 by JA Conner Platinum Aluminide Coating for Cobalt–Based Superalloys.
U.S. application No. 08/886,504, filed Jul. 1, 1997 by WD Grossklaus,Jr., etal Method for Repairing a Thermal Barrier Coating.
U.S. application No. 09/219,153 filed Dec. 22, 1998 by MA Rosenzweig, etal Method of Removing Hot Corrosion Products from a Diffusion Aluminide Coating.
U.S. application No. 09/219,162 filed Dec. 22, 1998 by JA Conner et al Coating of a Discrete Selective Surface of an Article.
U.S. application No. 09/219,163 filed Dec. 22, 1998 by JD Rigney, etal. Renewing a Thermal Barrier Coating System.
U.S. application No. 09/287,627 filed Apr. 7, 1999 by HJ Farr and JA Conner Method for Locally Removing Oxidation and Corrosion Product from the Surface of Turbine Engine Components.

* cited by examiner

*Primary Examiner*—Irene Cuda
(74) *Attorney, Agent, or Firm*—Andrew C. Hess; Gerry S. Gressel

(57) ABSTRACT

A gas turbine engine hot section component having a ceramic thermal barrier coating is repaired by removing the ceramic thermal barrier coating, removing oxidation products and corrosion products from the metallic bond coating beneath the ceramic thermal barrier coating, applying a noble metal to the component, diffusing the noble metal into the component substrate, and aluminiding the component to provide an outermost noble metal-Al layer.

13 Claims, No Drawings

REPAIR OF COATED TURBINE COMPONENTS

BACKGROUND OF THE INVENTION

This invention relates to the repair of gas turbine engine hot section components such as turbine airfoils.

Gas turbine engine components operating in the hot gas path environments of such engines are subjected to temperature extremes, oxidation and hot gas corrosion. Thermal barrier coating systems consisting of metallic bond coatings of, e.g., aluminide, Ni-aluminide or the like, followed by ceramic thermal barrier coatings consisting of yttria-stabilized zirconia or the like, are often applied to the surfaces of these components to protect them from such temperature extremes and degradation due to oxidation and hot gas corrosion. The metallic bond coatings typically have a thickness between about 0.001 inch (0.0025 cm) and about 0.004 inch (0.01 cm) for diffusion coatings and between about 0.003 inch (0.0076 cm) and about 0.007 inch (0.018 cm) for overlay coatings. The ceramic thermal barrier coatings typically have a thickness of from about 0.003 inch (0.0076 cm) to about 0.010 inch (0.0025 cm), typically about 0.005 inch (0.013 cm). Eventual degradation of these coatings in service necessitates their removal and re-application at repair intervals. Such removal and re-application of these coatings is a costly process and further results in reduced mechanical properties of the component due to thinning of component walls upon removal of coating interdiffused with substrate as compared to such properties after the prior original application of metallic bond coatings and ceramic thermal barrier coatings. A further disadvantage of removal and re-application of thermal barrier coating systems is that when re-applying the bond coat it is necessary to be concerned with minimizing the potential for in-service coating growth, because excessive coating growth can render the component non-repairable.

BRIEF SUMMARY OF THE INVENTION

A gas turbine engine hot section component such as a turbine blade is repaired by removing its ceramic thermal barrier coating as well as oxidation and corrosion products from the underlying metallic bond coating. A noble metal is then applied and diffused into the component substrate. The component is then aluminided to provide a noble metal-Al layer over the component substrate.

Other features of the invention will be in part apparent and in part pointed out hereinbelow.

DETAILED DESCRIPTION OF THE INVENTION

Gas turbine engine hot section components having a ceramic thermal barrier coating over a metallic bond coating are periodically removed from service for maintenance. In accordance with this invention, such a component which has been removed from service for maintenance is subjected to a process involving removal of the ceramic thermal barrier coating. This coating typically has a thickness on the order of between about 0.003 inch (0.0076 cm) and 0.010 inch (0.025 cm), more typically on the order of about 0.005 inch (0.013 cm). This removal is accomplished by chemical means. In one preferred embodiment of the invention this removal is accomplished according to the procedure disclosed in U.S. patent application Ser. No. 08/886,504, filed Jul. 1, 1997, entitled Method For Repairing A Thermal Barrier Coating, the entire disclosure of which is incorporated herein by reference.

After removal of the thermal barrier coating, oxidation products and corrosion products are removed by appropriate means, such as chemical and light mechanical means. In certain preferred embodiments of the invention, these products are removed by procedures disclosed in U.S. patent application Ser. Nos. 09/287,627 and 09/219,153, filed Apr. 7, 1999 and Dec. 22, 1998, respectively, entitled Method For Locally Removing Oxidation And Corrosion Product From The Surface Of Turbine Engine Components and Method Of Removing Hot Corrosion Products From A Diffusion Aluminide Coating, the entire disclosures of which are incorporated herein by reference.

A noble metal is then applied generally to the entire component or at least selectively to those localized regions of the component from which the aforementioned oxidation and corrosion products have been removed. The noble metal is preferably either Pt, Pd or Rh, with Pt selected in the majority of applications. The thickness of the noble metal coating applied in this manner is preferably on the order of about 0.0001 inch (0.00025 cm) to about 0.0004 inch (0.001 cm), more preferably on the order of about 0.0002 inch (0.0005 cm) to about 0.0003 inch (0.00076 cm).

The noble metal is preferably applied by plating, and plating shields and masking techniques are employed where only selected locations are to be plated. Whether the entire component is coated versus selected regions of the component depends in significant part on the configuration and size of the component.

The noble metal is then diffused into the surface of the substrate by thermal diffusion, which, depending on the substrate composition, results in a variety of species of noble metal aluminides such as Pt-aluminides.

The component bearing the noble metal diffusion layer is then aluminided by a suitable method to create a noble metal modified aluminide layer. Aluminiding is preferably carried out by a pack powder or vapor aluminiding process. The thickness of the aluminided layer is on the order of up to about 0.0005 inch (0.0013 cm) to about 0.006 inch (0.015 cm). In one preferred embodiment the thickness is between about 0.002 inch (0.005 cm) and about 0.004 inch (0.01 cm).

As a result of the foregoing surface restoration process the treated component has a protective environmental coating which exceeds life requirements for the next engine build. That is, the life of the coating under service conditions is greater than the service time until the next scheduled maintenance. Also, the costs associated with this process are less than the costs associated with prior processes involving removal, re-application of the bond coat and/or the ceramic thermal barrier coating. Furthermore, the reliability of the process of the invention is such that yield losses are reduced, and reduction in mechanical properties which has been associated with removal and re-application of the ceramic thermal barrier coating system is minimized. Still further, coating parameters can be selected to maximize coating life independent of coating growth concerns, which concerns have been a limiting factor in re-application of thermal barrier coating systems.

As various changes could be made in the above constructions without departing from the scope of the invention, it is intended that all matter contained in the above description shall be interpreted as illustrative and not in a limiting sense.

What is claimed is:

1. A method for repairing a gas turbine engine hot section component comprising an outer surface, a metallic bond coating over the outer surface, and a ceramic thermal barrier coating over the metallic bond coating, the method comprising:

removing the ceramic thermal barrier coating;

removing oxidation products and corrosion products from the metallic bond coating;

applying a noble metal to the outer surface of the component;

diffusing said noble metal into said outer surface; and aluminiding said outer surface to provide an outermost noble metal-Al layer.

2. The method of claim 1 wherein the noble metal is selected from the group consisting of Pt, Pd and Rh.

3. The method of claim 1 wherein the noble metal is Pt.

4. The method of claim 1 wherein said noble metal is applied to the outer surface to a thickness between about 0.0001 inch (0.00025 cm) and about 0.0004 inch (0.001 cm).

5. The method of claim 4 wherein said outermost noble metal-Al layer has a thickness between about 0.002 inch (0.005 cm) and about 0.004 inch (0.010 cm).

6. The method of claim 1 wherein said removing oxidation products and corrosion products from the metallic bond coating is performed only at specific locations of the metallic bond coating occupying less than all of the outer surface of the component.

7. The method of claim 6 wherein said applying a noble metal to said outer surface is performed substantially only at said specific locations occupying less than all of the component surface from which oxidation products and corrosion products are removed.

8. A method for repairing a gas turbine engine hot section airfoil comprising an airfoil body, a metallic bond coating over the airfoil body, and a ceramic thermal barrier coating over the metallic bond coating, the method comprising:

removing the ceramic thermal barrier coating;

removing oxidation products and corrosion products from the metallic bond coating on the airfoil body;

applying a layer of Pt to the airfoil body by plating;

diffusing the Pt into the airfoil body; and aluminiding the airfoil body to provide an outermost PtAl layer.

9. The method of claim 8 wherein said removing oxidation products and corrosion products from the metallic bond coating is performed only at specific locations of the airfoil body occupying less than all of the surface thereof.

10. The method of claim 9 wherein said applying a layer of Pt to the airfoil body is performed substantially only at said specific locations occupying less than all of the component surface from which oxidation products and corrosion products are removed.

11. A method for repairing a gas turbine engine hot section airfoil comprising an airfoil body, a metallic bond coating over the airfoil body, and a ceramic thermal barrier coating over the metallic bond coating, the method comprising:

removing the ceramic thermal barrier coating;

removing oxidation products and corrosion products from the metallic bond coating on the airfoil body;

applying a layer of Pt having a thickness between about 0.0001 inch (0.00025 cm) and about 0.0004 inch (0.001 cm) to the airfoil body by plating;

diffusing the Pt into the airfoil body; and aluminiding the airfoil body to provide an outermost PtAl layer having a thickness between about 0.002 inch (0.005 cm) and about 0.004 inch (0.010 cm).

12. The method of claim 11 wherein said removing oxidation products and corrosion products from the metallic bond coating is performed only at specific locations of the airfoil body occupying less than all of the surface thereof.

13. The method of claim 12 wherein said applying a layer of Pt to the airfoil body is performed substantially only at said specific locations occupying less than all of the component surface from which oxidation products and corrosion products are removed.

* * * * *